United States Patent [19]

Sakuma et al.

[11] 4,293,748

[45] Oct. 6, 1981

[54] VACUUM CIRCUIT INTERRUPTER ELECTRODES

[75] Inventors: Shinzo Sakuma, Yokohama; Hifumi Yanagisawa, Sagamihara, both of Japan

[73] Assignees: Kabushiki Kaisha Meidensha; Kabushiki Kaisha GEMVAC, both of Tokyo, Japan

[21] Appl. No.: 970,912

[22] Filed: Dec. 19, 1978

[30] Foreign Application Priority Data

Dec. 28, 1977 [JP] Japan ..... 52-160560

[51] Int. Cl.[3] ..... H01H 33/66

[52] U.S. Cl. ..... 200/144 B

[58] Field of Search ..... 200/144 B

[56] References Cited

U.S. PATENT DOCUMENTS 3,809,836 5/1974 Crouch ..... 200/144 B 3,845,262 10/1974 Hundstad ..... 200/144 B

FOREIGN PATENT DOCUMENTS 2638700 2/1978 Fed. Rep. of Germany ... 200/144 B 1505699 11/1967 France ..... 200/144 B

*Primary Examiner*—Robert S. Macon

*Attorney, Agent, or Firm*—McAulay, Fields, Fisher, Goldstein & Nissen

[57] ABSTRACT

An electric circuit interrupter including a pair of electrodes, one of the electrodes being relatively movable with respect to the other into and out of engagement with the other. At least one of the electrodes comprises an annular contact section and an arc driving section surrounding the annular contact section. The arc driving section is formed with a plurality of slots inwardly extending from the outer periphery of the arc driving section to divide it into arc driving segments. The slots are inclined at an angle with respect to the radius of the arc driving section and also inclined at an angle with respect to the axis of the arc driving section such that the arc driving segments can overlap the adjacent arc driving segments across the inclined slots.

9 Claims, 11 Drawing Figures

VACUUM CIRCUIT INTERRUPTER ELECTRODES

BACKGROUND OF THE INVENTION

1. Field of the Invention

The invention relates to an electrode structure for use in electric circuit interrupters of the type including a pair of separable electrodes disposed within a vacuumized chamber and, more particularly, to an electrode structure having at least one electrode comprised of an annular contact section and a slotted arc driving section surrounding the contact section for driving, circumferentially of the arc driving section, an arc column generated between the electrodes during circuit interruption.

2. Description of the Prior Art

First of all, a typical conventional vacuum-type circuit interrupter will be described with reference to FIG. 1 which is a longitudinal sectional view. The circuit interrupter comprises an evacuated envelope casing 10, cylinder flanges 11 and 12 secured to the opposite ends of the casing 10, upper and lower end caps 13 and 14 sealingly secured to the ends of the respective cylinder flanges 11 and 12, and an intermediate shield 15 secured to the casing 10. Located within the intermediate shield 15 are a pair of separable disc-shaped electrodes 20 and 30 having thereon annular contact sections 21 and 31, respectively. The lower electrode 20 is a movable electrode secured to a lower electrode rod 18 which extends through a bellows 16 and the lower end cap 14 and suitably mounted for vertical movement of the lower electrode contact section 21 into and out of engagement with the upper electrode contact section 31 without imparting the vacuum inside the envelop casing 10. The upper electrode 30 is a stationary electrode secured to an upper electrode rod 17 which extends through the upper end cap 13 and is sealingly secured thereto.

If the upper and lower electrodes 30 and 20 are in engagement with each other to close the circuit interrupter as shown in FIG. 1, a current I will flow through the annular contact sections 21 and 31. When the lower electrode 20 is moved away from the upper electrode 30 to open the circuit interrupter, an arc column will appear between the separated contact sections 21 and 31. In the presence of the interaction of a magnetic field produced by the arc column itself and a magnetic field produced by a circuit connected to the circuit interrupter, the arc column is very unstable and is driven along the surfaces of the electrodes in a radial direction outward to an outer peripheral region thereof under the influence of a magnetic field created by a current flowing through a ]-shaped path in the contact sections 21 and 31 to locally heat the region so as to cause a great amount of metallic vapors generated from the electrode surface. This will lower the degree of the vacuum inside the envelop casing 10 and spoil the circuit interrupting performance.

In order to effectively control the arc column appearing during circuit interruption so as to eliminate these disadvantages found in such conventional electrode structures, an attempt has been made to provide an arc driving section around at least one of the electrode contact sections, the arc driving section formed with a plurality of slots to divide it into arc driving segments for circumferentially driving the arc column without the arc column stopping on an outer peripheral region of the contact section so as to locally heat the region.

This attempt is intended to enchance arc column cooling performance so that circuit interruption can occur at a current of zero.

Conventional electrode structures of this type having such an arc driving section are shown in FIGS. 2 to 5. FIGS. 2 and 3 are plan and side views showing a so-called spiral electrode structure which has an electrode 20 comprised of an annular contact section 21 and an arc driving section 24 formed with a plurality of curved slots 23 inwardly extending from its outer periphery to form arc driving segments 22 angularly spaced around the contact section 21 in a generally spiral configuration. In such a spiral electrode structure, however, the arc driving segments 22 have their side surfaces cut normally to the direction of circumferential movement of the arc column and thus it is difficult for the arc column moving along the surfaces of the arc driving segments 22 to shift across the slots 23 to the next arc driving segments 22. Therefore, the arc column will stop on the tip end regions of the arc driving segments 22 to locally heat the regions so as to generate metallic vapors from the electrode surfaces thereby reducing the degree of the vacuum inside the envelope casing 10 to spoil circuit interrupting performance.

FIGS. 4 and 5 are plan and side views showing a so-called 卍-shaped electrode structure which has an electrode 20 comprised of an annular contact section 41 and an arc driving section 44 formed with four slots 43 inwardly extending from its outer periphery to form four arc driving segments 42 in a generally 卍-shaped configuration. Since the arc driving segments 42 have their side surfaces cut normally to the direction of circumferential movement of the arc column, the 卍-shaped electrode structure has the same disadvantages as described in connection with the spiral electrode structure of FIGS. 2 and 3.

SUMMARY OF THE INVENTION

It is therefore an object of the present invention to provide an improved electrode structure for use in a circuit interrupter which will be free from the above disadvantages found in conventional electrode structures.

A further object of the present invention is to provide an improved electrode structure which can promote circumferential movement of an arc column generated during circuit interruption.

A further object of the present invention is to provide an improved electrode structure which can provide high circuit interrupting performance.

These and other objects are accomplished in accordance with the present invention by providing an electrode structure including a pair of electrodes one of which is relatively movable with respect to the other into and out of engagement with each other, at least one of the electrodes comprising an annular contact section and an arc driving section surrounding the annular contact section being, the arc driving section formed with a plurality of slots inwardly extending from its outer periphery to divide it into arc driving segments, the slots being inclined at an angle with respect to the radius of the arc driving section and also inclined at an angle with respect to the axis of the arc driving section such that the arc driving segments can overlap the adjacent arc driving segments across the inclined slots.

The foregoing and additional objects and features of the present invention will appear from the following description in which the preferred embodiments have been set fourth in detail in conjunction with the accompanying drawings.

DESCRIPTION OF THE PREFERRED EMBODIMENTS

Figure 1:
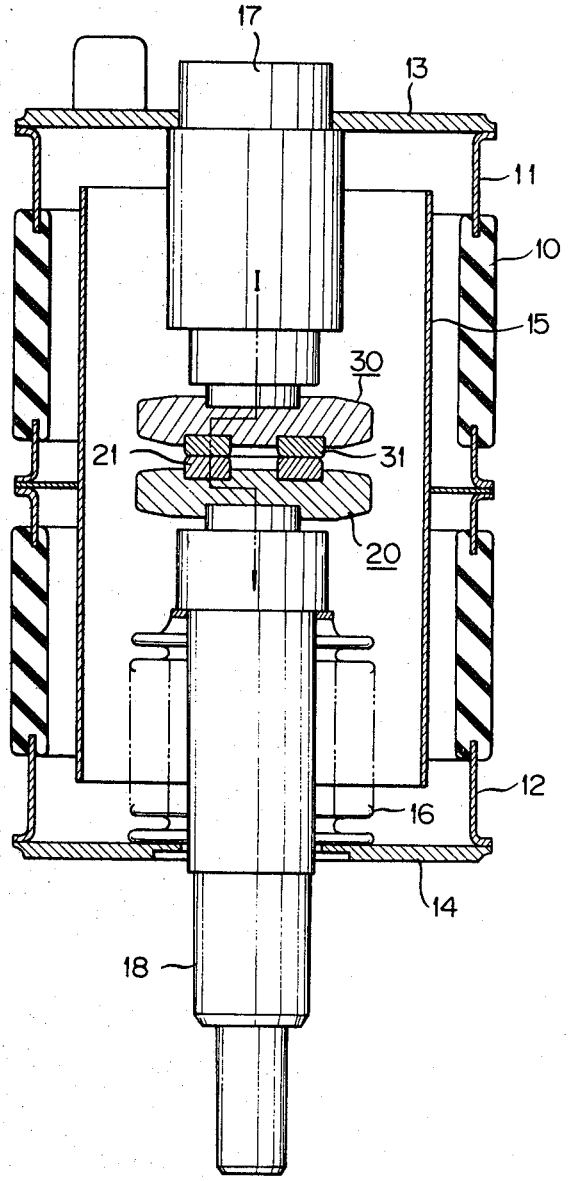
FIG. 1 is a longitudinal sectional view schematically showing a typical vacuum-type circuit interrupter.
Figure 2:
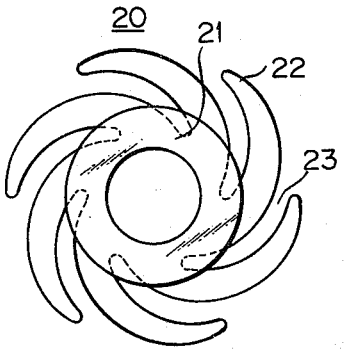
FIGS. 2 and 3 are plan and side views showing a conventional spiral electrode structure.
Figure 4:
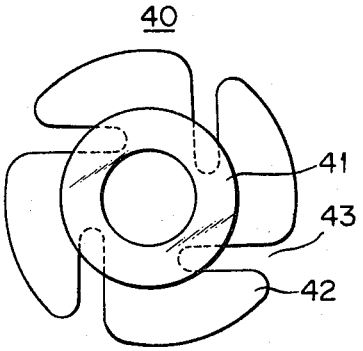
FIGS. 4 and 5 are plan and side views showing a conventional ⅄-shaped electrode structure.
Figure 3:
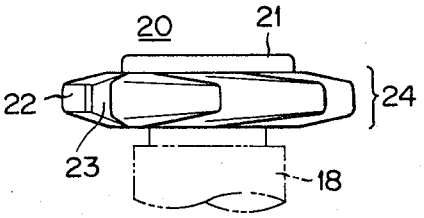
Figure 5:
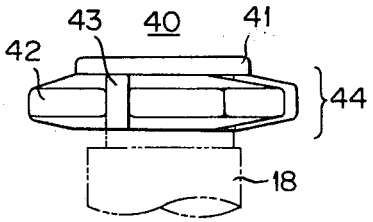
Figure 6:
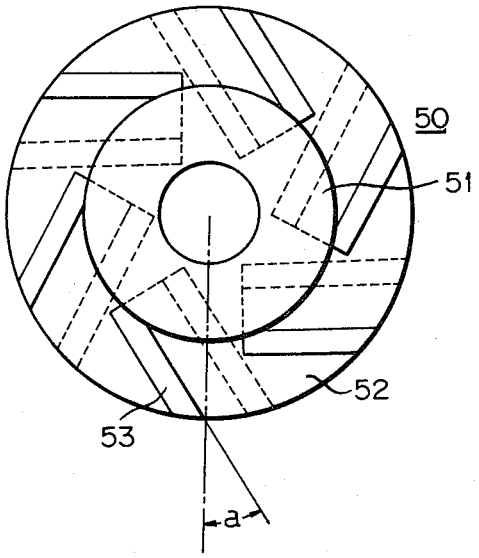
FIGS. 6 and 7 are plan and side views showing one embodiment of electrode structure made in accordance with the present invention.
Figure 7:
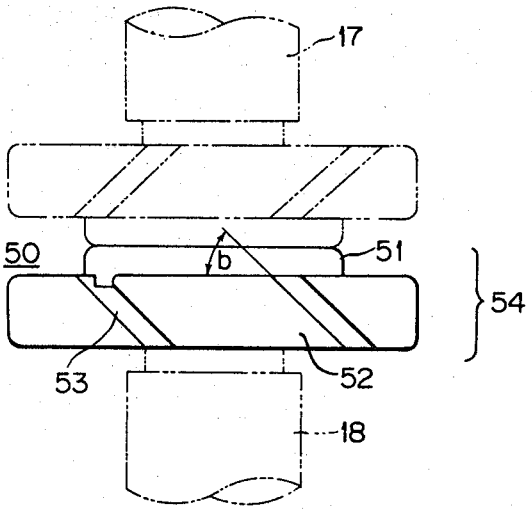
Figure 8:
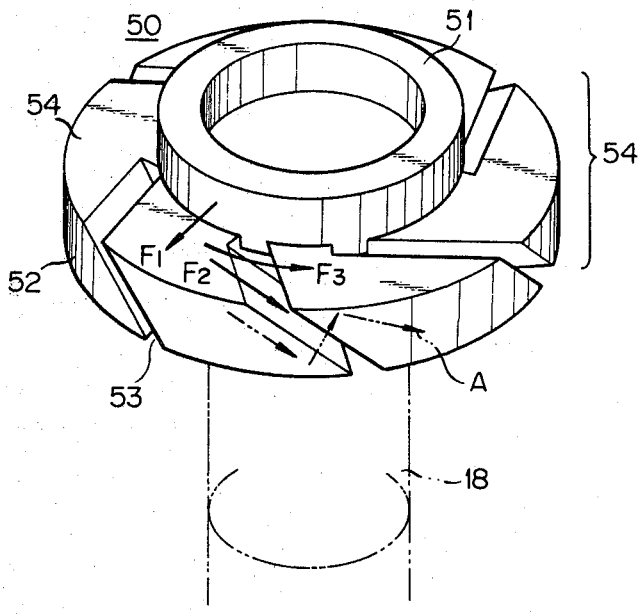
FIG. 8 is a perspective view showing the electrode structure of FIGS. 6 and 7.

Referring now to FIGS. 6 to 8 of the accompanying drawings, there is illustrated one preferred embodiment of electrode structure made in accordance with the present invention. The electrode structure includes a pair of electrodes, one of the electrodes being relatively movable with respect to the other between a closed position in engagement with the other and an open position separated from the other to form a circuit-interrupting arc column between the electrodes. At least one of the electrodes 50 comprises an annular contact section 51 and a disc-shaped arc driving section 54 surrounding the contact section 51. The arc driving section 54 is formed with a plurality of slots 53 inwardly extending from its outer periphery to form arc driving segments 52. The slots 53 are inclined in the same direction at an angle with respect to the radius of the arc driving section 54 as indicated by the letter a of FIG. 6 and also inclined in the same direction at an angle with respect to the axis of the arc driving section 54 as indicated by the letter b of FIG. 7 such that the arc driving segments 52 can overlap the adjacent segments 52 across the slots 53. The directions of inclination of the slots 53 with respect to the radius of the arc driving section 54 and to the axis thereof are the same.

With the above electrode structure, an arc column generated during circuit interruption will be driven at a speed in a radial direction outward from the annular contact section 51 to the arc driving section 54 or the arc driving segments 52 under the influence of a magnetic field produced by a current flowing through a ]-shaped path in the annular contact section 54 and then circumferentially driven along the surfaces of the arc driving segments 52. The arc column downwardly moves over its inclined side surface to shift across the slots 53 to the next arc driving segments 52. At this time, a component force F3 created by a force F1 of the arc column moving in the radial direction outward and a force F2 of the arc column moving downwardly over the inclined side surface of the arc driving segment 52 promotes circumferential movement of the arc column. The arc column having reached the outer peripheral regions of the arc driving segments 52 is driven along the inclined side surfaces thereof to the tip end regions thereof and then driven to the next arc driving segments 52 as indicated by the arrow A of FIG. 8 without the arc column stopping on the tip end regions.

Figure 9:
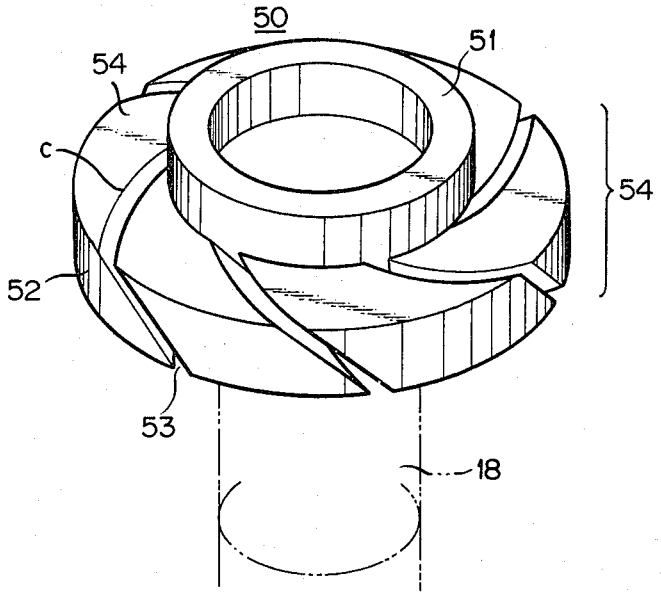
FIGS. 9 to 11 are perspective views showing modified forms of electrode structures of the present invention.
Figure 10:
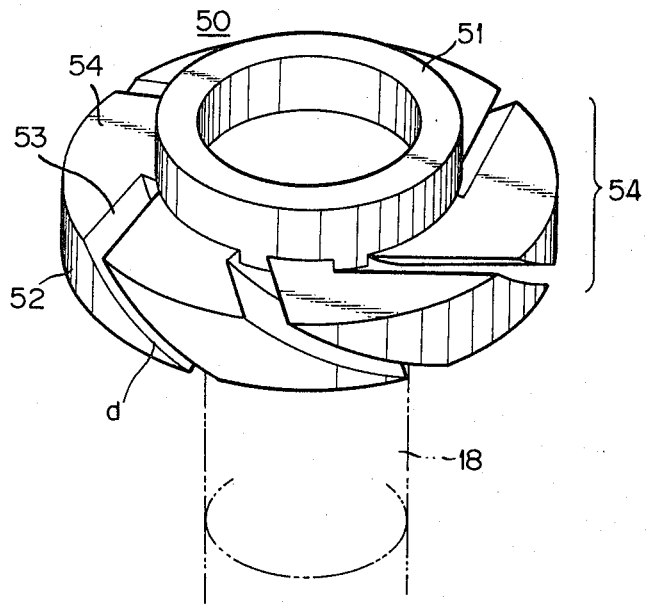
Figure 11:
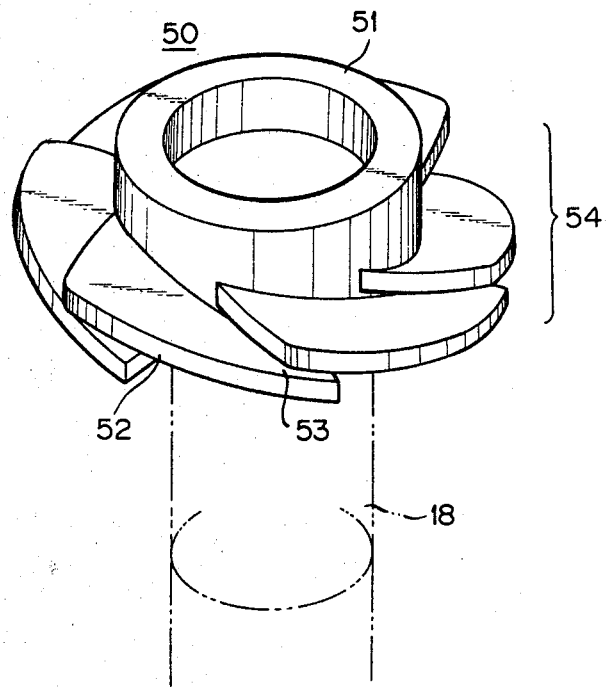

FIGS. 9 to 11 illustrate modified forms of electrode structure of the present invention, in which components like those in FIGS. 6 to 8 have been given the like reference numerals and will not be described further. FIG. 9 is a perspective view showing a first modified form of electrode structure of the present invention. In this form, the slots 53 formed in the arc driving section 54 are inclined at an angle with respect to the radius of the arc driving section 54 and also curved as indicated by the letter c of FIG. 9 such that each of the slots 53 has a curved transverse cross-section and a linear longitudinal cross-section. This structure can effectively drive the arc column circumferentially of the arc driving section 54. It is noted that the concaved side surfaces of the arc driving segments 52 may front in either direction with respect to the direction of circumferential movement of the arc column.

FIG. 10 is a perspective view showing a second modified form of electrode structure of the present invention. In this form, the slots 53 formed in the arc driving section 54 are inclined at an angle with respect to the axis of the arc driving section 54 and also curved as indicated by the letter d of FIG. 10 such that each of the slots 53 has a linear transverse cross-section and a curved longitudinal cross-section. This structure can effectively drive the arc column circumferentially of the arc driving section 54. It is noted that the concaved side surfaces of the arc driving segments 52 may front in either direction with respect to the direction of circumferential movement of the arc column. Although each slot 53 formed in the arc driving section 54 has been described in connection with FIGS. 6 to 10 as inclined in the same direction with respect to the radius of the arc driving section 54 and to the axis thereof, it is noted that the slot 53 may be inclined in opposite directions and at different angles.

FIG. 11 is a perspective view showing a third modified form of electrode structure of the present invention. In this form, the arc driving segments 52 are arranged like screw propeller blades such that the arc driving segments 52 can overlap the adjacent segments 52 across the slots 53 and such that each of the slots 53 has a curved transverse cross-section and a curved longitudinal cross-section. This structure can effectively drive the arc column circumferentially of the arc driving section 54.

The electrode structure constructed as described above in accordance with the present invention provides the following important advantages. Since a plurality of arc driving segments 52 are provided angularly around an annular contact section 51 such as to overlap the adjacent segments 52 across the slots 53 inclined at an angle in the same direction, the arc column generated during circuit interruption can be driven at a speed in a radial direction outward from the contact section 51 to the arc driving segments 52 and then driven along the surfaces of the arc driving segments circumferentially of the arc driving section 54 under the influence of a magnetic field produced by a current flowing through a ]-shaped path in the contact section. A component force F3 is created by a force F1 of the arc column moving in the radial direction outwardly and a force F2 of the arc column downwardly moving along the inclined side surfaces of the arc driving segments 52 so as to further promote circumferential movement of the arc column. The arc driving segments 52 having their inclined side surfaces overlapping the adjacent arc driving segments 52 so that the arc column can move therealong to their tip ends thereby smoothly shifting across the slots 53 to the next arc driving segments without the arc column stopping on their tip ends can further promote circumferential movement of the arc column. Furthermore, since the slots 53 are inclined with respect both to the radius of the arc driving section 54 and to the axis thereof, the outer peripheral surfaces and side surfaces of the arc driving segments can be effectively utilized to drive the arc column circumferentially of the arc driving section. Accordingly, the electrode structure of the present invention can effectively drive the arc column circumferentially of the arc driving section 54 without the arc column stopping on its outer peripheral region thereby to eliminate such a problem found in conventional electrode structures that the electrodes are locally heated to emit a great amount of metallic vapors from their surfaces to reduce the degree of the vacuum inside the envelop casing and thus spoil circuit interrupting performance.

In addition, although an arc spot having reached the outer peripheral region of the contact section between adjacent arc driving segments will be distributed to the arc driving segments and driven outwardly along their surfaces in conventional spiral and 卍-shaped electrode structures, it will be outwardly driven along the inclined surface of an arc driving segments in the electrode structure of the present invention.

Since the electrode of the present invention is of a flat disc-shape as viewed from its upper surface, increased circuit interrupting performance will be expected if the electrode structure of the present invention is used in a circuit interrupter designed for high voltage or small current circuits. Effective utilization of the side surfaces of the electrode and the arc driving segments to circumferentially drive the arc column permits reduction in electrode size and thus in distance between the electrode and the intermediate shield, resulting in a small-sized circuit interrupter.

Additionally, since the slots 53 of an electrode structure shown in FIGS. 6 to 8 can easily be formed merely by linearly cutting an electrode set in an inclined position, it is possible to manufacture relatively small-sized electrodes with ease and thus to produce compact circuit interrupters with high circuit interrupting performance.

While the present invention has been particularly shown and described with reference to preferred embodiments thereof, it will be understood by those skilled in the art that the foregoing and other changes in form and details may be made therein without departing from the spirit and scope of the invention.

What is claimed is:

1. In a circuit interrupter having a pair of electrodes, one of said electrodes being relatively movable with respect to the other between a closed position in engagement with the other and an open position separated from the other to form a circuit-interrupting arc column between said electrodes, wherein the improvement comprises:

at least one of said electrodes comprises an annual contact section and a disc-shaped arc driving section surrounding said annular contact section, said arc driving section being formed with a plurality of slots extending inwardly from its outer periphery to divide it into arc driving segments, said slots being inclined at an angle with respect to the radius of said arc driving section and also being inclined at an angle with respect to the axis of said arc driving section such that said arc driving segments can overlap the adjacent arc driving segments across said inclined slots, said arc driving segments together with said slots between adjacent ones of said arc driving segments being interrelated such that an arc column generated during circuit interruption moves in the direction which makes an acute angle with respect to said slots in the plane facing the other electrode.

2. In a circuit interrupter as set forth in claim 1, in which each of said slots has a linear transverse cross-section and a linear longitudinal cross-section.

3. In a circuit interrupter as set forth in claim 1, in which each of said slots has a curved transverse cross-section and a linear longitudinal cross-section.

4. In a circuit interrupter as set forth in claim 1, in which each of said slots has a linear transverse cross-section and a curved longitudinal cross-section.

5. In a circuit interrupter as set forth in claim 1, in which each of said slots has a curved transverse cross-section and a curved longitudinal cross-section.

6. In a circuit interrupter as claimed in claim 1, wherein each of said slots are inclined in the same direction and at the same angle with respect to said arc driving section, and each of said slots are inclined in the same direction and at the same angle with respect to the axis of said arc driving section.

7. In a circuit interrupter as claimed in claim 1, wherein the directions of inclination of said slots with respect to the radius of said arc driving section and to the axis thereof are the same.

8. In the circuit interrupter of claim 3 or 4, wherein each of said arc driving segments have a concaved side surface all facing in the same direction.

9. In the circuit interrupter of claim 5, wherein said arc driving segments are arranged like screw propeller blades to provide for said arc driving segments to overlap adjacent ones of said arc driving segments across said slots.

* * * * *

UNITED STATES PATENT AND TRADEMARK OFFICE

CERTIFICATE OF CORRECTION

PATENT NO. : 4,293,748

DATED : October 6, 1981

INVENTOR(S) : Shinzo Sakuma et al

It is certified that error appears in the above—identified patent and that said Letters Patent is hereby corrected as shown below:

Column 1, line 34 correct the spelling of "envelope"

lines 54 to 55 change "a great amount of metallic vapors" to --a large quantity of metallic vapor-- line 57 correct the spelling of "envelope"

Column 2, line 1 correct the spelling of "enhance"

Column 3, line 2 correct the spelling of "forth"

Column 5, line 16 change "a great amount of metallic vapors" to --a large quantity of metallic vapor-- line 18 correct the spelling of "envelope"

Signed and Sealed this

Tenth Day of August 1982

[SEAL]

Attest:

GERALD J. MOSSINGHOFF

Attesting Officer

Commissioner of Patents and Trademarks